US006822621B2

(12) United States Patent
Lamour et al.

(10) Patent No.: US 6,822,621 B2
(45) Date of Patent: Nov. 23, 2004

(54) MONOPOLE OR DIPOLE BROADBAND ANTENNA

(75) Inventors: Frédéric Lamour, Courbevoie (FR); Gil Maugrion, Beaumont (FR); Ivan Wolk, Arnouville lés Gonnesse (FR)

(73) Assignee: Thales, Paris (FR)

( * ) Notice: Subject to any disclaimer, the term of this patent is extended or adjusted under 35 U.S.C. 154(b) by 0 days.

(21) Appl. No.: 10/370,057

(22) Filed: Feb. 21, 2003

(65) Prior Publication Data

US 2003/0214455 A1 Nov. 20, 2003

(30) Foreign Application Priority Data

Feb. 22, 2002 (FR) ..... 02 02303

(51) Int. Cl.[7] ..... H01Q 1/36
(52) U.S. Cl. ..... 343/896
(58) Field of Search ..... 343/896, 899, 343/897

(56) References Cited

U.S. PATENT DOCUMENTS 1,792,662 A 2/1931 Sterba ..... 343/896
3,618,105 A 11/1971 Bruene et al. ..... 343/747
4,835,542 A * 5/1989 Sikina, Jr. ..... 343/896
5,173,713 A 12/1992 Yves et al. ..... 343/749
5,644,321 A * 7/1997 Benham ..... 343/826
5,673,055 A * 9/1997 Hansen ..... 343/899
5,969,687 A 10/1999 Podger ..... 343/742
6,198,454 B1 * 3/2001 Sharp et al. ..... 343/773
6,486,846 B1 * 11/2002 Hart ..... 343/896

FOREIGN PATENT DOCUMENTS

FR 2501422 A1 9/1982
GB 2150359 A 6/1985

* cited by examiner

*Primary Examiner*—Don Wong
*Assistant Examiner*—Ephrem Alemu
(74) *Attorney, Agent, or Firm*—Lowe Hauptman Gilman & Berner, LLP

(57) ABSTRACT

An antenna comprises one or more radiating strands where at least one radiating strand has both its ends connected by means of one or more conductive wires, the radiating strands forming part of the upper pole of the antenna. Application to monopole or dipole type antennas working in the frequency ranges corresponding to the HF, VHF or UHV bands.

20 Claims, 8 Drawing Sheets

MONOPOLE OR DIPOLE BROADBAND ANTENNA

BACKGROUND OF THE INVENTION

1. Field of the Invention

The invention relates to the field of monopole or dipole type broadband antennas (antennas with passive tuners).

It is applied, for example, to wire antennas in the context of telecommunications or jamming systems.

2. Description of the Prior Art

In broadband monopole (FIG. 1) or dipole type (FIG. 2) broadband antennas, the classic technique most commonly used to obtain satisfactory properties in a broadband consists in widening the poles by means of metal wires or strands, one for the upper pole and three for the lower pole.

A passive antenna tuner 2 makes it possible to refine the matching of the antenna with very wide frequency bands.

In this way, tactical, transportable (mountable and dismountable) antennas with a reduced wind-load area are obtained. A large number of strands ensures satisfactory omnidirectional properties in azimuth but entails penalties in terms of assembly time and wind-load constraints.

The matching is especially easy as the angle $\alpha$ (the angle between a radiating strand 1 and the vertical) is relatively great, generally ranging from 10° to 45°. It is important to be able to match the antenna naturally with a given VSWR (voltage standing wave ratio) or SWR (standing wave ratio) typically ranging from 2 to 3, because this gives the antenna high efficiency while preventing high buffer (attenuator) values.

However, a big angle value, for example $\alpha>15°$, is often incompatible with the usual mechanical and operational constraints, such as wind behavior, weight, implementation time etc, especially at the relatively low frequencies (2–30 MHz high frequency band) or at the bottom of the VHF band (several tens of MHz) where the length of the radiating strands commonly ranges from a few meters to more than about 10 meters.

One solution used to compensate for these mechanical constraints lies in substantially strengthening the seatings of the radiating strands, especially for the radiating strands of the upper pole. This strengthening is accompanied however by major additional constraints of cost, transportation and tactical qualities of the antenna (namely, greater weight, increased mounting and dismantling time, the need for greater numbers of operators, bulkier infrastructures to take greater weight, greater wind-load area, etc.)

In the wire antennas of the prior art, therefore, the angles of inclination of the strands rarely exceed 15° (the angle is taken with reference to the vertical axis of the figure). The matching is then adjusted with inductance-capacitance cells and by means of buffers or attenuators.

SUMMARY OF THE INVENTION

The object of the present invention relates to an antenna in which the extremities of the radiating strands are connected, for example, to their base or to the seating by means of a conductive wire capable of bearing the transmission power of the antenna. For example, the radiating strands of the upper pole are connected to the seating of the upper pole.

The invention relates to a wire antenna comprising one or more radiating strands, said strands being connected to a seating, wherein at least one of said strands has a first end connected by means of a conductive wire to said seating or connected to its second end.

The radiating wire forms part, for example, of the upper pole of the antenna and the connecting wire is a metal wire or a Teflon®-coated metal wire.

The invention relates for example to the monopole or dipole type antennas used for example in the HF, VHF or UHF bands ranging from some MHz to some hundreds of MHz.

The antenna according to the invention has the following advantages in particular:

- improved efficiency as compared with the usual wire antennas,
- preservation of its tactical qualities and ease of use,
- the additional cost of the metal wires connecting the upper strands to the seating of the pole is negligible as compared with the total cost,
- a novel architecture that entails no penalties for the implementation of the system or for the antenna mounting and dismantling time,
- negligible extra weight and space requirement for the metal wires,
- improved stability of the strands when they are relatively long (several meters) and flexible under wind stresses, and consequently a stabilizing of the radiation at the top of the band where there are risks of flattening of the antenna patterns through the variable incurvation of the upper strands,
- the addition of metal wires optimizes the matching of the antenna through the forming of thick strands, thus bring about a substantial improvement in the efficiency of the antenna (the buffers/attenuators needed have lower values).

BRIEF DESCRIPTION OF THE DRAWINGS

Other features and advantages of the antenna according to the invention shall appear from the following description given by way of an illustration that in no way restricts the scope of the invention and made with reference to the following drawings of which.

MORE DETAILED DESCRIPTION

The antenna manufacturing technique according to the invention optimizes the matching of the antenna while ensuring tactical and cost properties comparable to those of antennas matched with buffers (attenuators).

Figure 1:
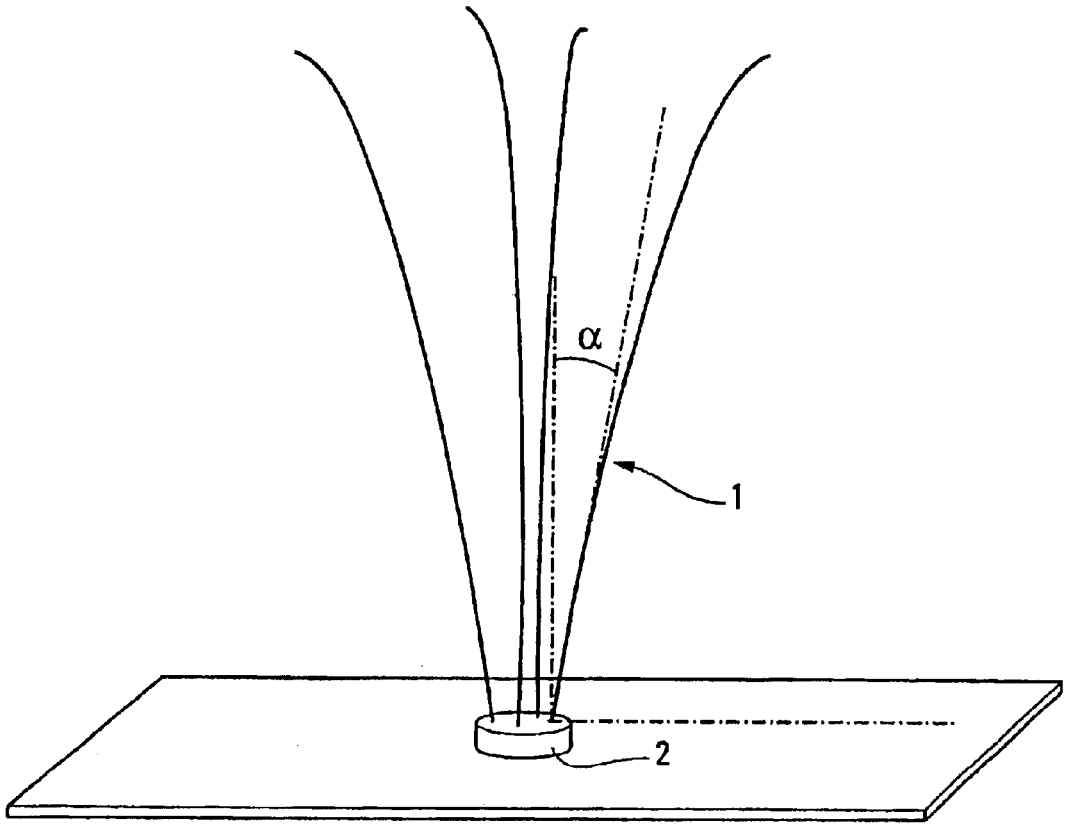
PRIOR ART Fig. 1
FIGS. 1 and 2 show prior art monopole and dipole broadband wire antennas.
Figure 2:
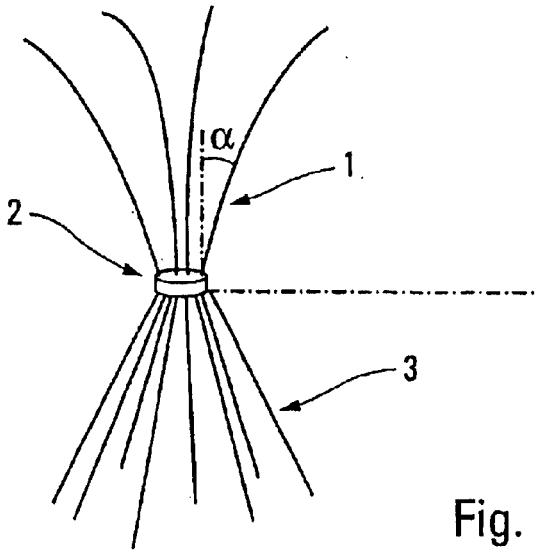
Fig. 2 PRIOR ART
Figure 3:
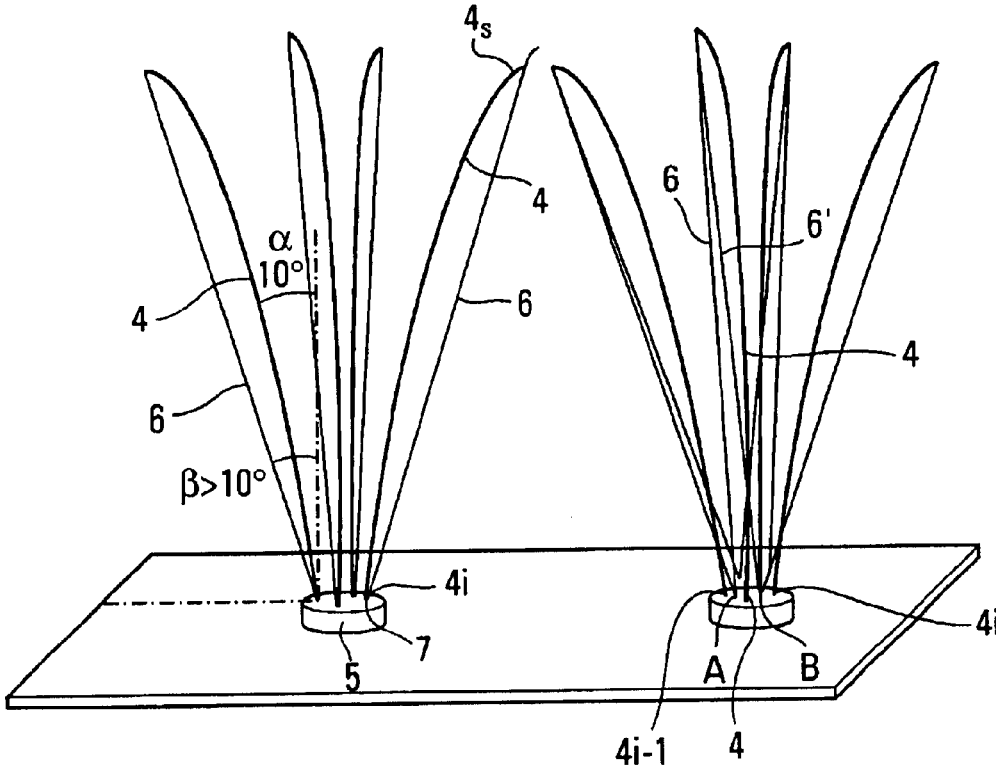
FIG. 3 shows a first exemplary antenna architecture according to the invention.

FIG. 3 shows a first alternative embodiment of a broadband antenna according to the invention.

This antenna comprises, for example, four upper radiating strands referenced 4 linked with an antenna tuner 5. The upper strands 4 form, for example, an angle of inclination α of about 10° to 15° to the vertical. The upper end 4*s* of a radiating strand is connected, for example, by means of a conductive wire, for example a metal wire 6, to the seating 7 of the upper pole (for example at its end $\mathbf{4}_i$) giving the antenna the appearance of a palm tree. The connection between a radiating strand 4 and the connection wire (metal wire 6) is obtained for example by using banana type plugs. Banana plugs are known to those skilled in the art and are capable of bearing the power irradiated by the antenna (these plugs are not shown in the figure for the sake of clarity). Any other means, for example soldering, capable of making this connection may also be used.

The upper strands 4 are of the metal or composite type (they may be metal strands coated with composite material).

The connecting wire 6 used is chosen especially as a function of its behavior under power radiated by the antenna. It may be made of metal and Teflon®-coated. The choice of the diameter of the connecting wire is, for example, a compromise between the mechanical resistance of the assembly, its behavior under power and the wind-load area. The length of the wire connecting the upper strand to the seating is a function especially of the curvature of the upper strand by gravity.

Advantageously, such an architecture enables the broadening of the antenna band. This is because, firstly, the value of the angle β between the vertical and each metal wire is greater than the value of the angle α and, secondly, because the radiating strands thus formed appear to be thick and naturally offer broadband properties.

The number of upper strands connected may be equal to the number of upper strands of the antenna.

Figure 4:
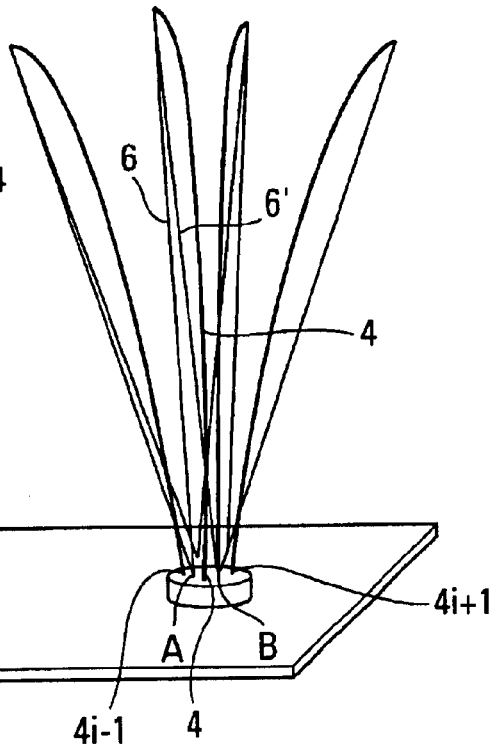
FIG. 4 is a variant of FIG. 3.

FIG. 4 shows an alternative embodiment in which another strand 4 is connected by two connecting wires 6, 6' to the seating 7. The contact point (A, B) of the wires with the seating is located, for example, at middistance between the feet of the radiating strands ($\mathbf{4}_{i-1}$, $\mathbf{4}_{i+1}$) adjacent to the concerned strand 1 (see FIG. 4).

Figure 5:
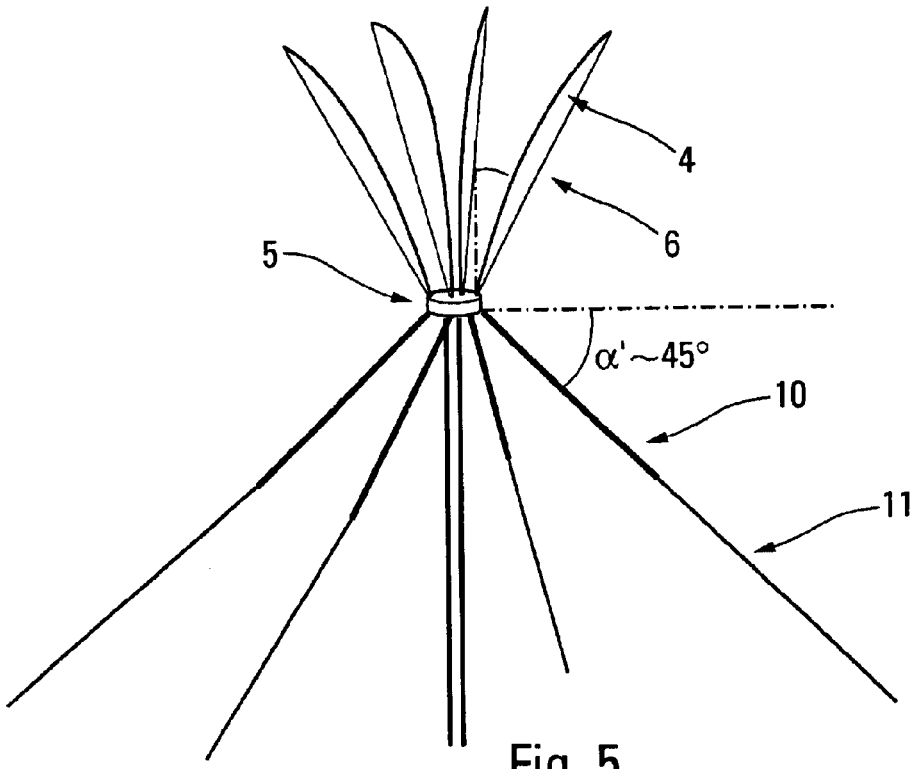
FIG. 5 shows an application of the structure according to the invention to a dipole type antenna.

According to another alternative embodiment, FIG. 5 shows a dipole type antenna in which the upper wires 4 of the upper pole are connected. The wires 10 of the lower pole may be significantly set off from the vertical by means of bracing 11. The principle of connection by metal wires is not necessarily applied at this lower pole, and the angle may take a great value without difficulty. In the figure the angle α' made by a radiating strand 10 of the lower pole with the horizontal is about 45°.

In the examples given in FIGS. 4 and 5, the strands of the antenna thus modified and having a "thick strand" structure substantially reduce the variations of the real and imaginary parts on a broadband (the resonating structure is less selective) and enable better matching with classic passive elements (transformers, inductors, capacitors).

The matching is adjusted by methods known to those skilled in the art and shall not be described in detail. Adjusting the matching therefore calls for attenuator values that are lower than those used in classic antennas (according to the prior art). This optimizes the efficiency of the antenna.

The examples given here above can be applied to HF antennas working, for example, in the 2–30 MHz range. These are high-power (ranging for example from some hundreds of watts to some kW) antennas formed by metal radiating strands coated with composite material and having lengths of more than 10 meters. They can also be applied to antennas used in frequency ranges corresponding to the HF, UHF or VHF bands varying from some MHz to some hundreds of MHz.

FIGS. 6 to 13 show the results of simulation obtained on a dipole type antenna. The simulation software is commercially distributed by the firm Nittany Scientific under the name NEC Winpro.

Figure 6:
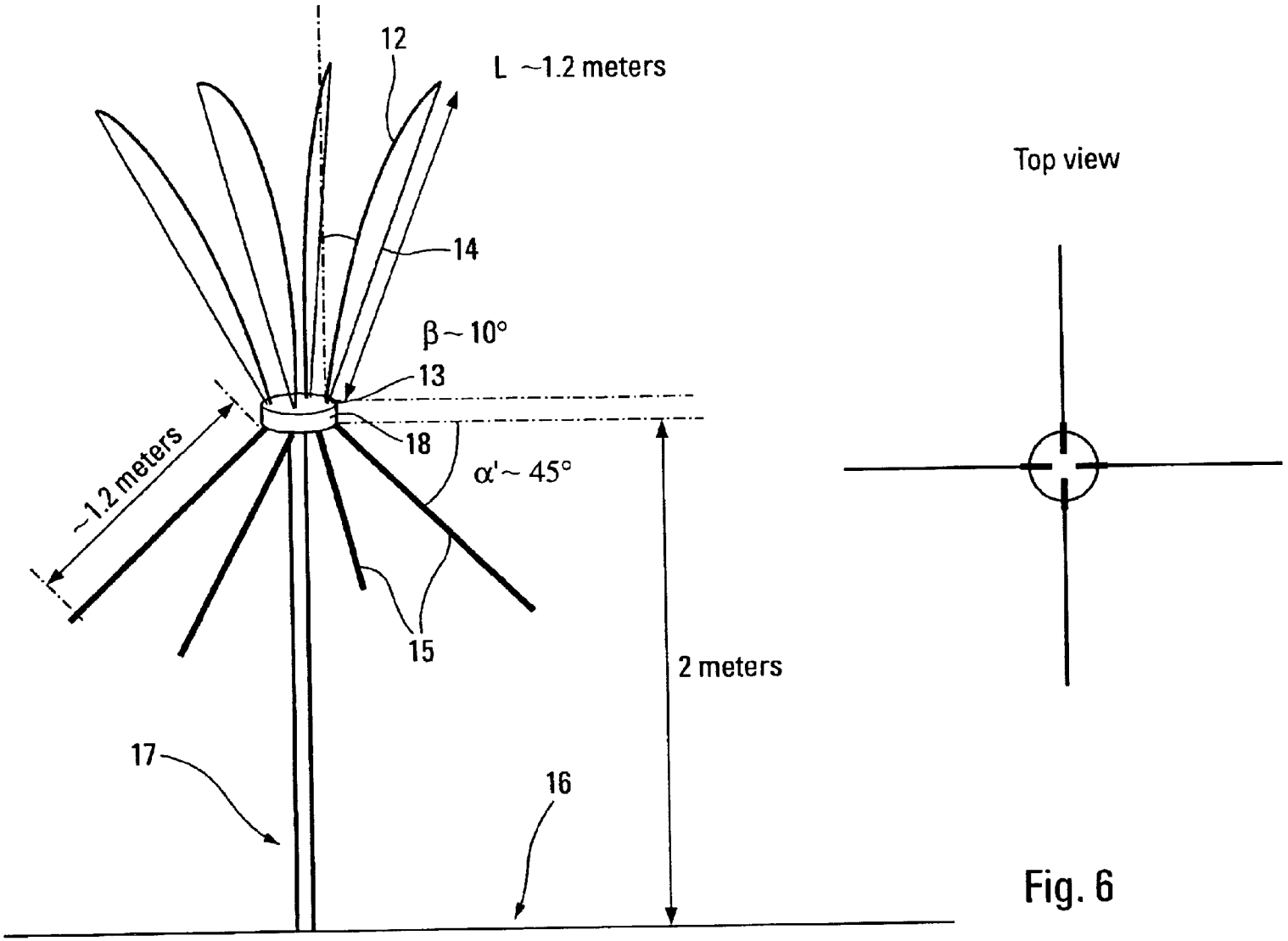
FIGS. 6 to 13 show an exemplary antenna and results of simulation obtained on different types of antenna.
Figure 7:
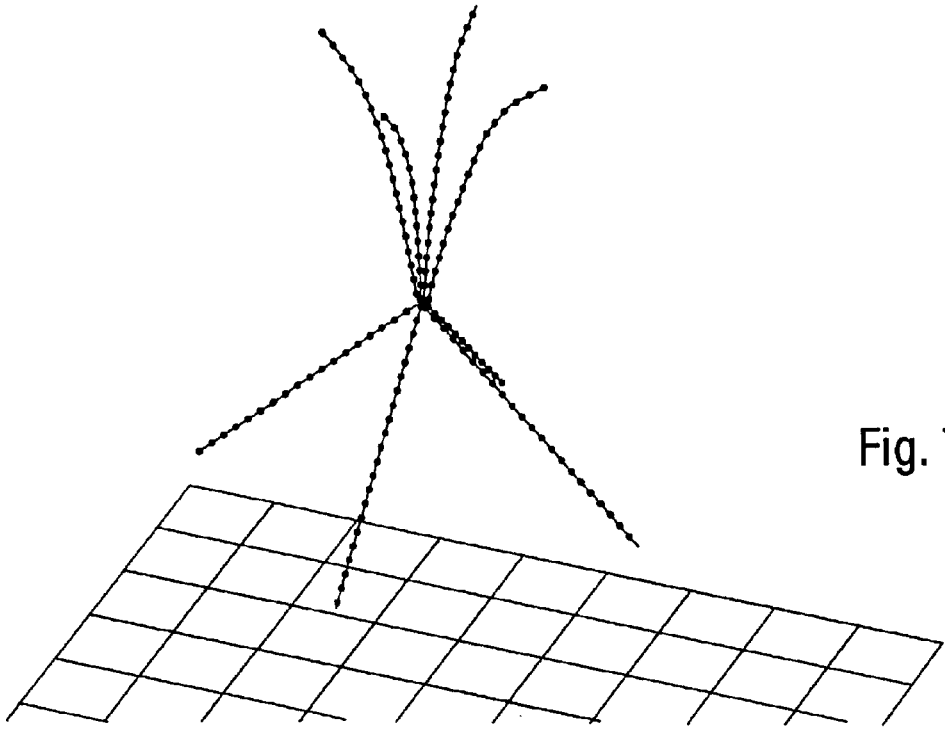
Figure 8:
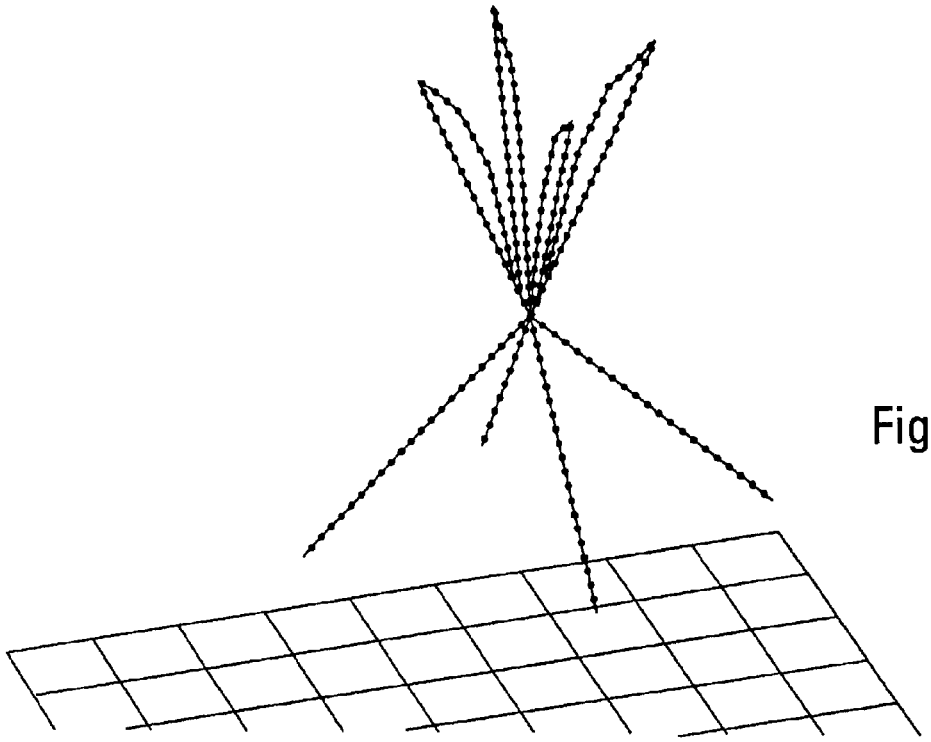
Figure 9:
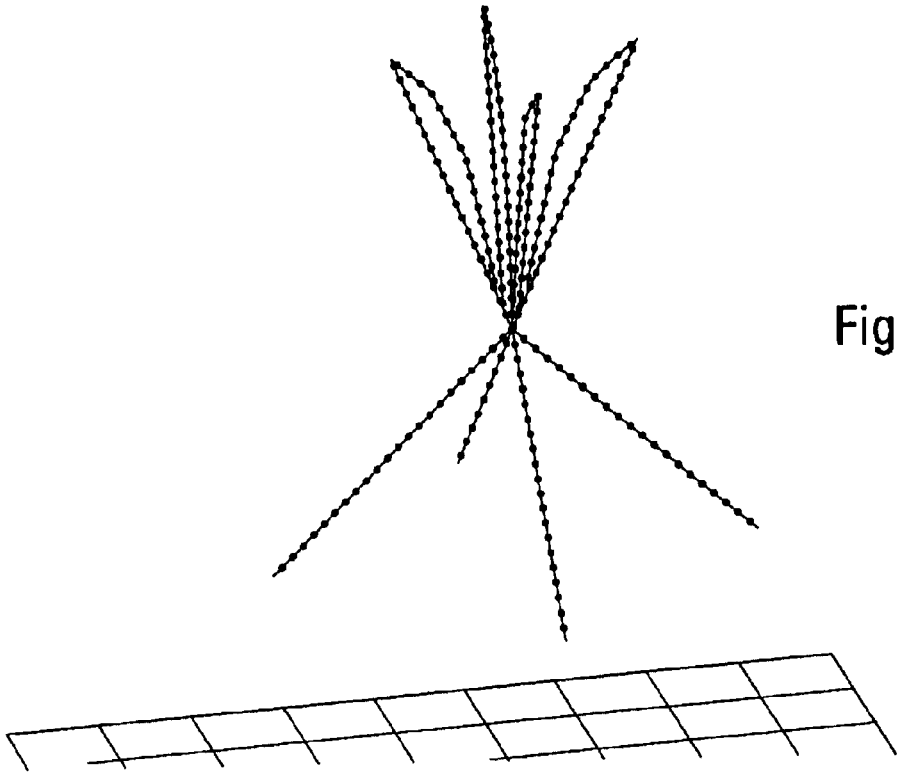

The structure of the antenna used is given in FIG. 6. It comprises an upper pole consisting of four radiating strands 12, having lengths L equal to about 1.2 meters. The strands are placed at 90° to each other and each form an angle β of 10° to the vertical at their base. They are connected to the seating 13 by means of a wire 14.

The lower pole consists of four radiating wires 15. The wires are 1.2 meters long and are positioned at 90° to each other. Each radiating wire is inclined by 45°. The phase center of the antenna is located, for example, at two meters above an average type of ground level 16.

The supporting mast 17 is made of composite material. The antenna tuner 18 is located between the lower pole and the upper pole.

FIGS. 7, 8, 9, 10 give a schematic view of the simulated representation respectively of a standard prior art antenna, an antenna with one wire connecting the upper end of the strand and the base of the strand, and antenna with two wires connecting the end of each of strand and placed midway between the two feet, an antenna with rigid wires having no upper strand.

Figure 11:
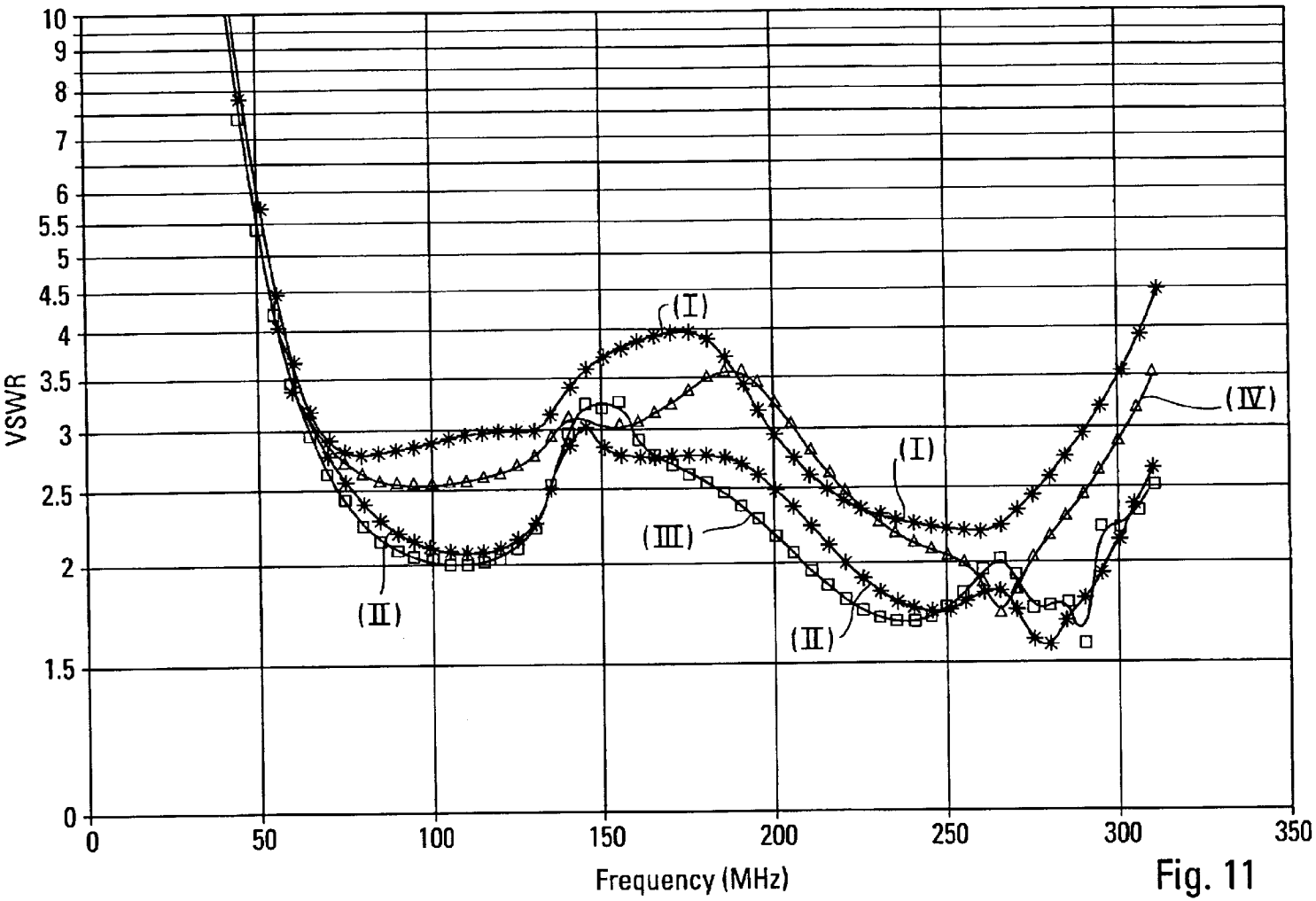

FIG. 11 shows associated SWR curves as a function of frequency.

Figure 10:
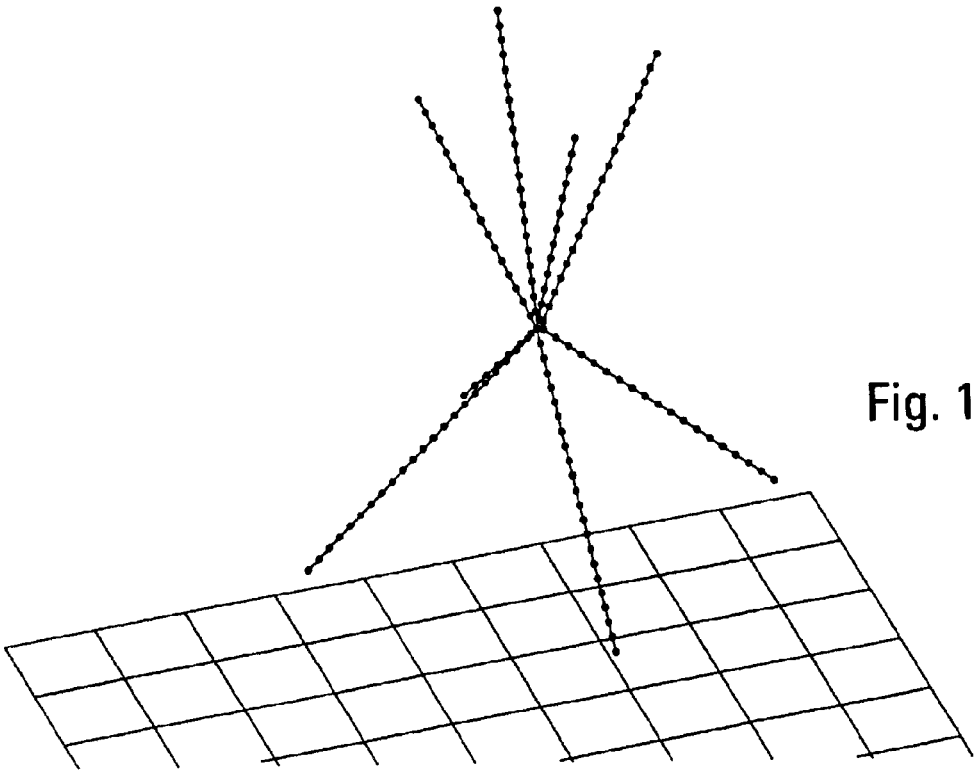

The curves I correspond to the classic antenna (FIG. 7), the curves II to the one-wire antenna (FIG. 8), the curves III to the two-wire antenna (FIG. 9), the curves IV to the wires alone (FIG. 10).

Figure 12:
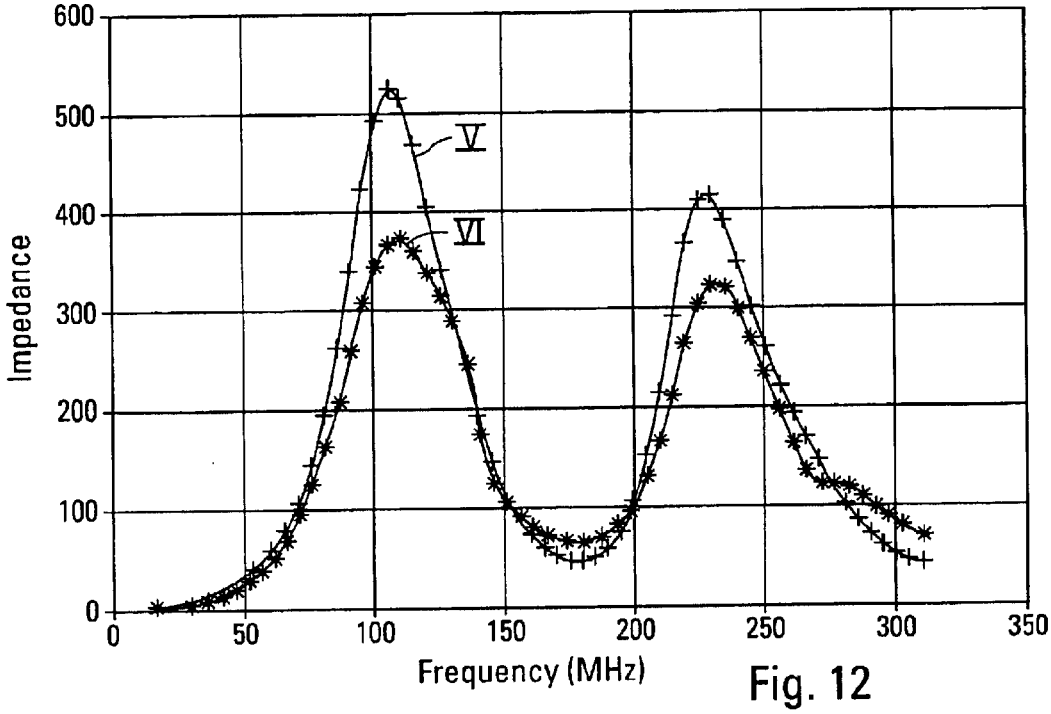
Figure 13:
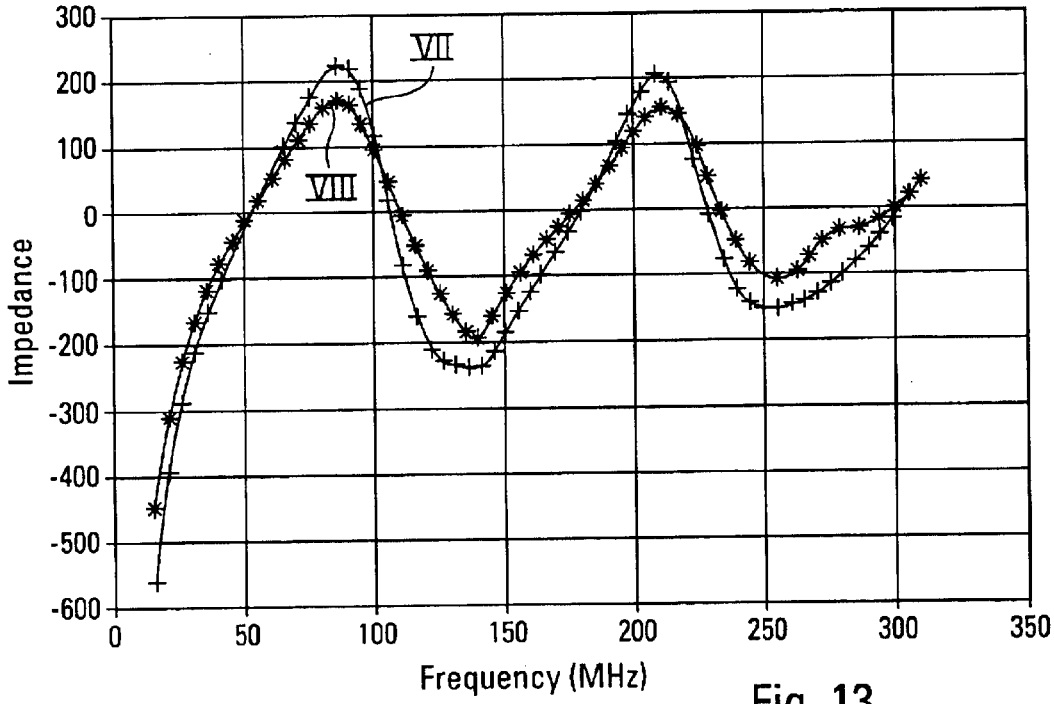

FIGS. 12 and 13 show the real part of the input impedance of the antenna and the imaginary part of the input impedance of the antenna respectively for a classic antenna (real part curve V, imaginary part curve VII) and a one-wire antenna (real part curve VI, imaginary part curve VIII).

These simulations reveal the effect of the wires connected to the radiating strands. The strands restrict the amplitude of the variations of the imaginary and real parts of the input impedance of the antenna. This is one of the properties of the wider-band structure antennas.

This drop in the dynamic range of the variations in input impedance makes it possible, by means of an appropriate conversion ratio, to obtain an antenna with an SWR smaller than or equal to 3 on a very wide band (varying for examples from 60 to 300 MHz in the present case) with one wire per radiating strand as against a maximum SWR of 4 for the classic antenna.

It may be noted that the antenna structure with two wires per radiating strand offers an SWR smaller than or equal to 3.2.

The influence of the wires alone is given in the curve IV of FIG. 11. These wires give an SWR smaller than or equal to 3.5 because of a more pronounced inclination with respect to the vertical, but the combined effect of the wires connected to the radiating strands which form thick strands appears to be more efficient.

The proposed solution makes it possible especially to make a 6–30 MHz or 60–300 MHz antenna with an SWR smaller than or equal to 3 having very high efficiency (a single transformer with a ratio 1:4 is sufficient).

These examples are given by way of an illustration and in no way restrict the scope of the invention.

Figure 14:
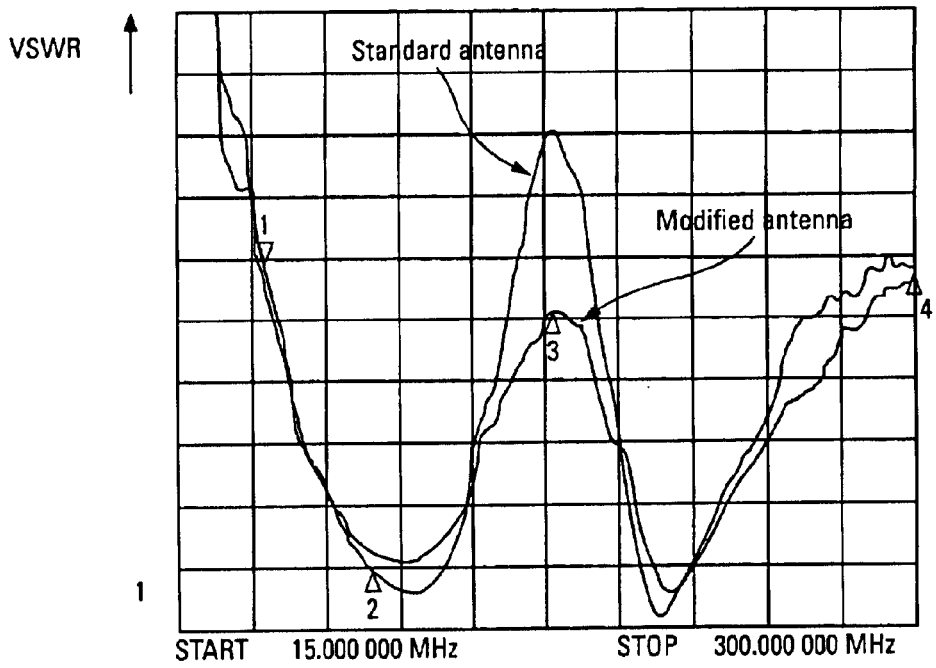
FIGS. 14 and 15 show the SWR obtained respectively with the classic antenna and an antenna modified according to the invention.
Figure 15:
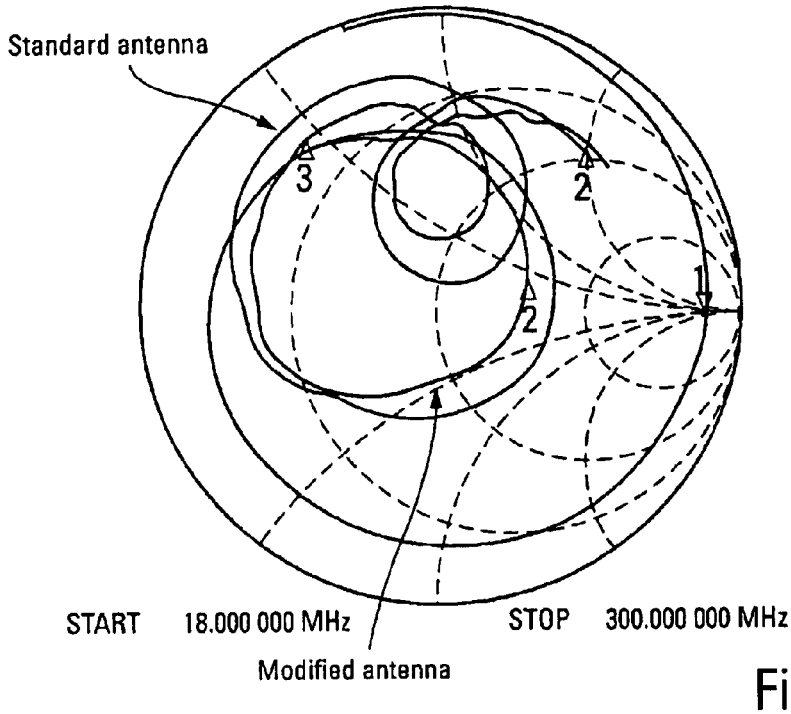

FIGS. 14 and 15 represent the readings of input impedance of the antenna measured with the network analyzer and shown respectively in the form of SWR values and a Smith's chart.

The effect of the drop in SWR on the band appears with the modification of the antenna. There is a maximum SWR of 9 for the standard antenna and 6 for the modified antenna. Similarly, for the Smith's chart, it can be seen that the resonance loops are less pronounced with the modified antenna, thus making it easier to carry out the matching.

What is claimed is:

1. A wire antenna comprising one or more radiating strands, each of said strands each being connected to a seating, wherein said strands each have a respective first end connected to a first end of a respective conductive wire and to said seating and a second end connected to a second end of each respective conductive wire, wherein each of said strands is spaced apart from said other strands.

2. The antenna according to claim 1 wherein the connected radiating strands are strands of the upper pole of the antenna.

3. The antenna according to claim 1, wherein a first end of a radiating strand is associated with the end of two wires, the other end of the wires being located midway between the opposite end of said strand and an opposite end of a second radiating strand.

4. The antenna according to claim 1, wherein the conductive wire is a metal wire.

5. The antenna according to claim 1, wherein the conductive wire is a polytetrafluoroethylene-coated metal wire.

6. The antenna according to claim 1, wherein the links between a radiating strand and a conductive wire are banana type plugs.

7. The antenna according to claim 1, wherein the antenna is a monopole antenna.

8. The antenna according to claim 1, wherein the antenna is a dipole antenna.

9. A use of an antenna in claim 1, wherein the frequency range corresponds to the HF, UHF or VHF frequency bands, ranging from some MHz to some hundreds of MHz.

10. The antenna according to claim 2, wherein a first end of a radiating strand is associated with the end of two wires, the other end of the wires being located midway between the opposite end of said strand and an opposite end of a second radiating strand.

11. The antenna according to claim 2, wherein the conductive wire is a metal wire.

12. The antenna according to claim 3, wherein the conductive wire is a metal wire.

13. The antenna according to claim 2, wherein the conductive wire is a polytetrafluoroethylene-coated metal wire.

14. The antenna according to claim 3, wherein the conductive wire is a polytetrafluoroethylene-coated metal wire.

15. The antenna according to claim 2, wherein the links between a radiating strand and a conductive wire are banana type plugs.

16. The antenna according to claim 3, wherein the links between a radiating strand and a conductive wire are banana type plugs.

17. The antenna according to claim 4, wherein the links between a radiating strand and a conductive wire are banana type plugs.

18. The antenna according to claim 5, wherein the links between a radiating strand and a conductive wire are banana type plugs.

19. The antenna according to claim 10, wherein the antenna is a monopole antenna.

20. The antenna according to claim 10, wherein the antenna is a dipole antenna.

* * * * *